United States Patent [19]

Higgs

[11] Patent Number: 4,477,117

[45] Date of Patent: Oct. 16, 1984

[54] WHEEL CHAIRS

[76] Inventor: Arthur B. Higgs, 32 Whistler Ave., Unley Park, South Australia, Australia

[21] Appl. No.: 287,733

[22] PCT Filed: Nov. 21, 1980

[86] PCT No.: PCT/AU80/00095

§ 371 Date: Jul. 22, 1981

§ 102(e) Date: Jul. 22, 1981

[87] PCT Pub. No.: WO81/01365

PCT Pub. Date: May 28, 1981

[30] Foreign Application Priority Data

Nov. 22, 1979 [AU] Australia ..... PE01447

[51] Int. Cl.[3] ..... A47C 4/28

[52] U.S. Cl. ..... 297/45; 297/DIG. 4

[58] Field of Search ..... 297/45, DIG. 4, 347, 297/348

[56] References Cited

U.S. PATENT DOCUMENTS

| | | | |
|---|---|---|---|
| 2,578,382 | 12/1951 | Thompson | 297/348 |
| 2,641,306 | 6/1953 | Lerman | 297/45 |
| 2,679,283 | 5/1954 | Mahone | 297/DIG. 4 |
| 3,023,048 | 2/1962 | Barton | 297/DIG. 4 |
| 3,374,493 | 3/1968 | Herrera | 297/45 |
| 3,618,968 | 11/1971 | Greer | 297/DIG. 4 |
| 3,985,389 | 10/1976 | Bonfield | 297/DIG. 4 |
| 4,140,341 | 2/1979 | Rabe | 297/45 |
| 4,371,183 | 2/1983 | Dion | 297/DIG. 4 |

*Primary Examiner*—Francis K. Zugel

*Attorney, Agent, or Firm*—Harlan P. Huebner

[57] ABSTRACT

A folding wheel chair having means (22) to elevate the seat (11) and back rest portion relative to the main frames (2) of the wheel chair is disclosed. The seat portion (11) is mounted to be vertically slidable on a pair of side frames (16). The lower portion of the side frames and the seat portion are interconnected by cross struts. Means (22) elevate the side frames relative to the main frame which carries the wheels (7,8) of the wheel chair so that on elevating the side frames, the side frames and the seat portion (11) raise as a unit together with the cross struts to maintain the wheel chair in the unfolded condition.

3 Claims, 3 Drawing Figures

WHEEL CHAIRS

This invention relates to improvements in and relating to wheel chairs, which would enable the user of the wheel chair to be elevated so that the user can more readily reach and see places and areas which are at present inaccessible to the user.

BACKGROUND OF THE INVENTION

Large numbers of incapacitated people live in their own homes, and these paraplegic people are confined to moving around their homes in a wheel chair and carrying out their household activities from these wheel chairs.

However from the safety point of view the chairs are designed to have a very low center of gravity so as to increase the stability of the wheel chairs. However this low design is of distinct disadvantage and is considered to be extremely dangerous when household chores and duties are carried out from the low wheel chair, for example cooking, washing or the like.

Thus users of a wheel chair often have to cook on a stove with the top of the stove being at the eye level of the user in the wheel chair and this causes a very dangerous situation.

DISCUSSION OF PRIOR ART

Folding wheel chairs are known, for example as shown in U.S. Pat. Nos. 4,166,631 and 4,140,341 which basically comprise two side frames interconnected by cross struts. These struts are connected to the arm rests which are slidable vertically in the side frames. As the chair folds by bringing the side frames together, the arm rests rise due to the movement of the cross struts.

Wheel chairs which have means to elevate the seat are also known, as shown for example in U.S. Pat. Nos. 1,219,834 3,215,469, 2,982,336 and 2,578,382, but these do not have any provision for folding the wheel chair, and with the construction shown it is not possible to fold the chairs.

Referring now to United Kingdom Pat. No. 922175 there is shown a folding wheel chair having a seat portion which is adapted to be elevated. The seat is mounted on a hydraulic ram supported on a frame work which is adapted to be clipped to the side rails of the chair. The seat frame work and hydraulic ram must be removed before the chair can be collapsed. And thus the seat frame work and hydraulic ram must be separately carried and stowed.

However for those patients living at home and those patients who require transport between various places, it is virtually essential for the chair to be collapsible in a simple manner so that they can be easily transported and stowed. Also it is highly desirable that the patient be able to be raised and lowered in the chair for safely carrying out household chores, cooking, preparing meals, washing, and also for activities in industry and at their places of employment.

It is thus an object of this invention to provide a wheel chair or an attachment for fitting to a wheel chair which will enable the seat and back rest portion of the wheel chair to be elevated so that the user can then be raised on the seat.

It is a further object of this invention to provide a mechanism for or incorporated in a wheel chair whereby the user himself may raise him or herself in the seat by simple manipulation of a lever or switch, and the chair collapsed when required in the usual manner.

BRIEF STATEMENT OF THE INVENTION

Thus there is provided according to the invention a folding wheel chair comprising a pair of spaced parallel main side frames each carrying a rear wheel and a forward wheel, a seat and back rest frame vertically slidable relative to the main frame and stabilising means interconnecting the two sides of the wheel chair, characterised by a side frame between each said main frame and said seat and back rest frame, means to raise to said side frame relative to said main frame to thus raise said seat and back rest portion and elevate same relative to said main frames while maintaining the main frames in spaced parallel position.

BRIEF DESCRIPTION OF THE DRAWINGS

In order to more fully the describe the invention reference will now be made to the accompanying drawings in which.

Figure 1:
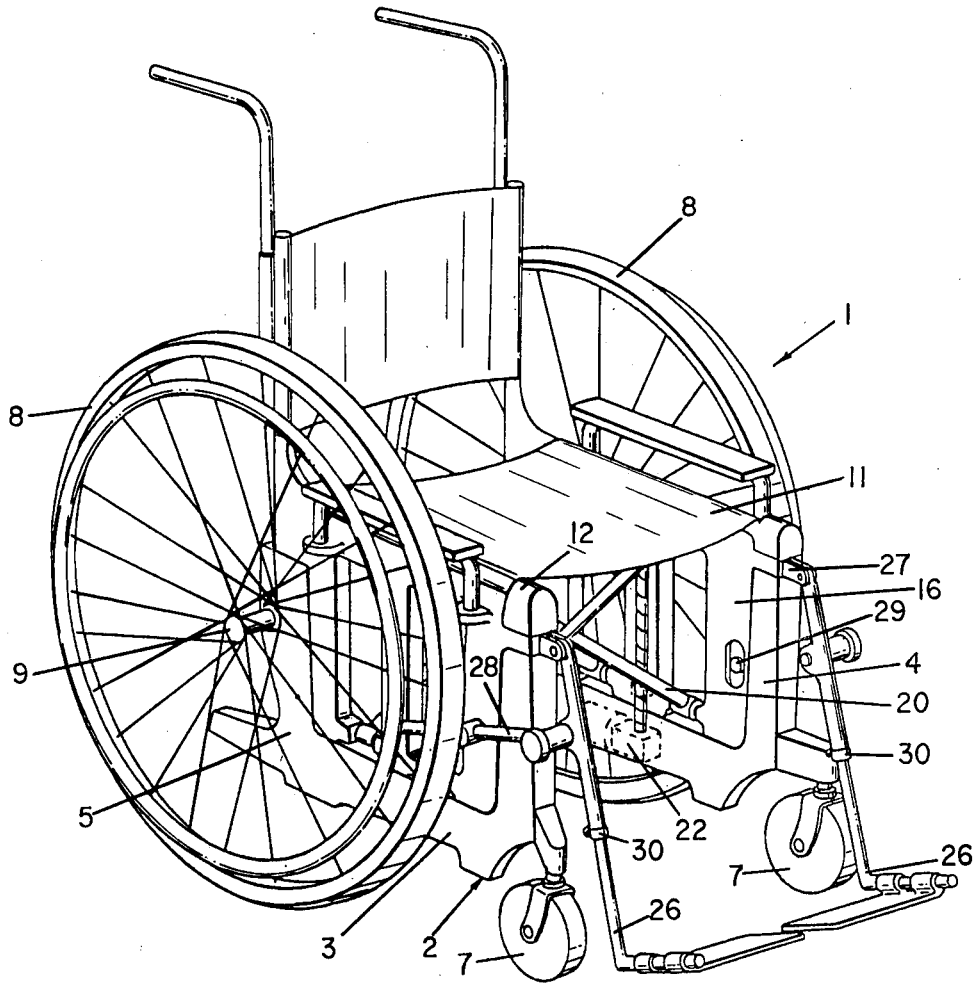
FIG. 1 is a view of the wheel chair in its lowered position.
Figure 2:
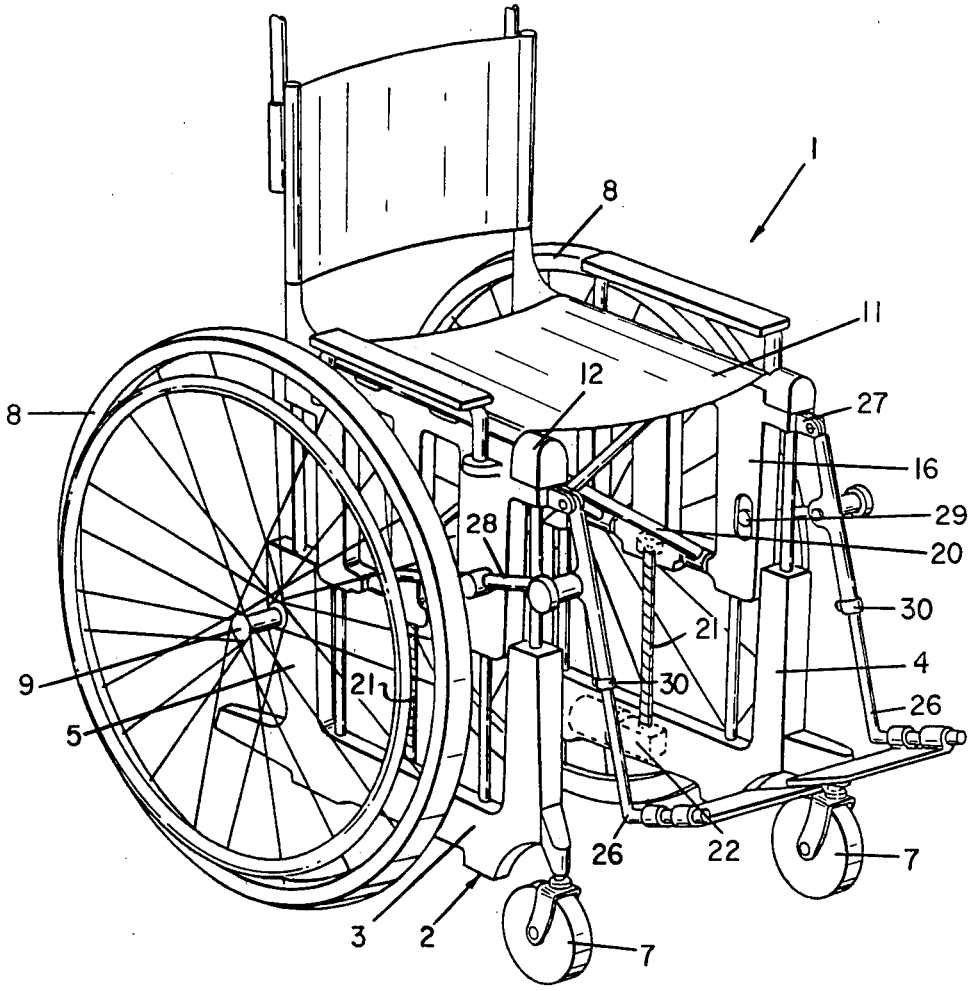
FIG. 2 is a view of the wheel chair in its raised position.
Figure 3:
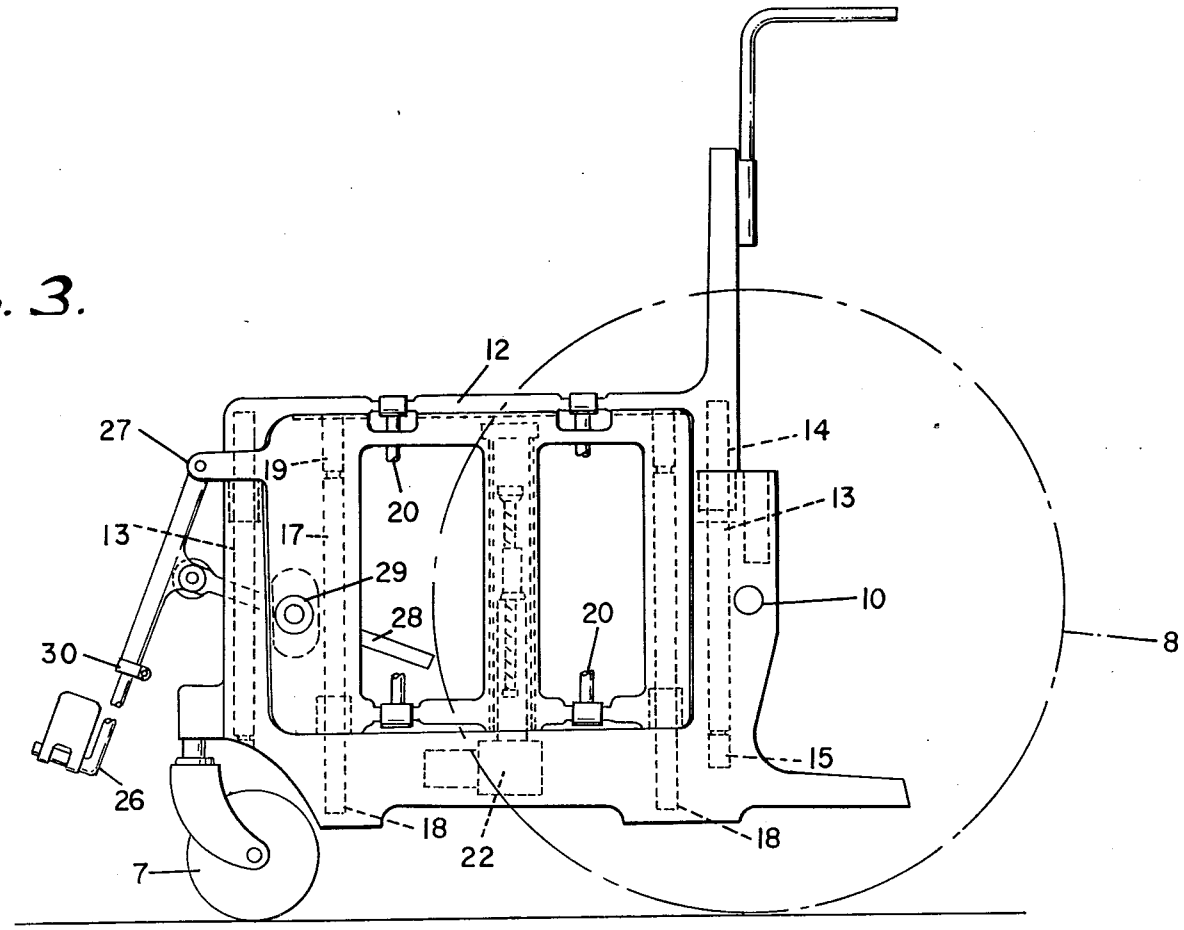
FIG. 3 is a side elevation of one of the sides of the wheel chair.

The wheel chair 1 comprises frame works on each side of the wheel chair and for convenience the majority of the description will refer only to one side.

The frame work comprises a main frame 2 having a base portion 3, a forward upright portion 4 and a rear upright portion 5, the forward upright portion 4 carrying a socket 6 for the front castor wheel 7 while the rear wheels 8 are mounted on a main axel 9 in axel carrier hole 10 in the rear upright portion 5.

The flexible seat 11 is attached to the rising rest 12 supported on the front and rear upright portions by guide rods 13 mounted in holes 14 in the rising rest 12 and slidable in that which is 15 in the front and rear upright portions 4 and 5. The rising rests are adapted to rise relative to the main frame during the folding of the chair in the usual manner.

Between the main frame 2 and the rising rest 12 there is provided a side frame 16. Guide rods 17 are mounted in holes 18 in the main frame 2 and slide in holes 19 in the side frame 16.

The cross stabilising struts 20 are each pivoted to the lower portions of the side frame 16 and the rising rest 12 so that the chair can then be folded in a manner similar to conventional chairs.

An elevating device such as a "Saginaw" jacked screw 21 is provided on each side between the side frame 16 and the main frame 2, these being mounted on the main frame and having the nut member mounted on the side frame. These elevating devices can be driven by an electric motor and gear box 22 or manually by a handle (not shown).

It will be seen that on elevation of the seat that the elevating device will lift the side frames 16 which will in turn lift the rising rest and thus the seat. These will be guided in their movement by the side frame guid rod 17 and the rising rest guide rods 13. The elevating devices are located on the line of the center of gravity of the patient for minimum strain and balancing of the moments of force.

The rising rest 12 in the seat is provided with a back rest 23, the handles 24 thus can be detached and be mounted in sockets 25 in the back rest 23.

The foot rest 26 can be pivoted to arm 27 on the side frame 16, and adjustably positioned by stabilising arm 28 which is adjustably positioned by adjusting nut 29.

The height of the foot rest can be positioned by telescopic arms and clamp 30 while the rests 31 themselves are pivoted to the ends of the telescopic arms.

If the elevating devices are electrically driven the chair would be provided with a bracket or the like to carry the battery which is preferably a rechargable dry cell. If the chair is to be collapsed this battery may have to be removed, but could be positioned so that removal is not necessary, so that the chair collapses in a manner similar to known chairs, the rising rest 16 rising in its guide rods 13 during the collapsing motion.

The chair can be constructed to any suitable material, either strong light weight metal or plastics material. For example the side frames and main frames could be made from a material sold under the trade name "Lexan".

In an alternative form rams having a piston and cylinder arrangement can interconnect the respective frames at the front and rear of the frames to elevate the seat frame. Thus two frames may be added to an existing wheel chair and two or four rams would be interconnected so that they operate simultaneously on the supply of fluid pressure.

This fluid pressure could be hydraulic with the pump drawing the hydraulic fluid from a hydraulic reservoir, or alternatively air could be used in which case on release of the air pressure from the pneumatic pistons and cylinders the air would just be released through a bleed valve.

It will be realised that the invention would have to be varied to be adapted to various forms of wheel chairs, especially those of the folding type or other speciality wheel chair.

The fluid rams can be interconnected to either a hydraulic pump if hydraulic rams are used, or a pneumatic pump either of the reciprocating or rotary variety which can be operated by a lever or the like situated adjacent the arm rest of the wheel chair.

In those wheel chairs which are driven by electric motors from batteries, the pumps could be driven from a small electric motor driven by the battery or alternatively there could be incorporated in the lifting frames a mechanical lifting arrangement in which, a screw and nut arrangement can be utilised to raise and lower the seat, the screw and nut arrangement being driven by appropriate electric motors.

It is realised that this may be a severe drain on the battery, but in certain situations depending upon the invalidity of the patient, this may well be desirable.

In those chairs which fold, the stabilising and locking bars would be situated on the frame work to lock the wheel chair and stabilise the wheel chair in the spread position particularly when the weight of the user is in the chair, but that the framework would be such that the seat portion could be raised and lowered as desired.

In some wheel chairs this may require the addition of a separate stabilising or locking part to be inserted between the two frames to allow the wheel chair seat to be raised, particularly in those chairs where the stabilising bar acts on the upper part of the frame or on the lower portion of the seat portion. This would vary depending upon the make and type of wheel chair and the locking and stabilising arrangement.

It will be seen that by raising the seat even ten or twenty centimeters would enable the user to have access to a larger number of areas in situations, and to work in these areas and situations with greater degree of safety.

Of course the seat could be elevated up to thirty centimeters, but it is realised that as the height increases then the stability of the wheel chair has to be taken into consideration due to the much higher center of gravity of the wheel chair user combination.

The invention can also be incorporated in the chairs during manufacture and the chair frame itself could be used as the pipe work for conducting the fluid from the pump to the rams.

Although various froms of the invention have been described in some detail it is to be realised that the invention is not to be limited thereto but is to include various modifications falling within the spirit and scope of the invention.

I claim:

1. A folding wheel chair comprising:

a pair of spaced parallel main frames each carrying a real wheel and a forward wheel;

a seat and back rest frame vertically slidable relative to the main frames;

a flexible seat and back rest carried by said seat and back rest frame;

a side frame between each of said main frames and said seat and back rest frame, each said side being vertically slidably mounted on guides on each respective main frame;

cross strut stabilizing means interconnecting a lower portion of each of the side frames to the seat and back rest frame;

elevating means connected between said side frames and said main frames to raise said side frames relative to said main frames to thus raise said seat and back rest portion relative to said main frames while maintaining said frames in spaced parallel relationship, whereupon on folding the said chair said seat and back rest frame rises relative to the side frames through cooperating movement of said cross strut stabilizing means.

2. A folding wheel chair as defined in claim 1 wherein:

said seat and back rest frame is carried on the upper portion of said side frames and is mounted on guides in said frames whereby said seat and back rest frame is not only capable of vertical movement with said side frames but capable of vertical movement independent of said side frames when said wheel chair is folded.

3. A folding wheel chair is defined in claim 1 wherein said elevating means comprises:

a screw and nut driven by power means;

said power means and screw being mounted on said main frame and said nut mounted on said side frame.

* * * * *